US010414115B2

(12) United States Patent
Rees et al.

(10) Patent No.: US 10,414,115 B2
(45) Date of Patent: Sep. 17, 2019

(54) SYSTEM AND METHOD FOR MAKING A FOLDED ARTICLE

(71) Applicant: G&K-VIJUK INTERN. CORP., Elmhurst, IL (US)

(72) Inventors: Achim Rees, Chicago, IL (US); Thomas Angst, Schömberg-Schörzingen (DE); Robert Kummer, Wellendingen (DE)

(73) Assignee: G&K-VIJUK INTERN. CORP., Elmhurst, IL (US)

( * ) Notice: Subject to any disclaimer, the term of this patent is extended or adjusted under 35 U.S.C. 154(b) by 1368 days.

(21) Appl. No.: 14/257,603

(22) Filed: Apr. 21, 2014

(65) Prior Publication Data

US 2015/0298419 A1 Oct. 22, 2015

(51) Int. Cl.
*B31F 1/00* (2006.01)
*B65H 45/04* (2006.01)
(Continued)

(52) U.S. Cl.
CPC ..... *B31F 1/0019* (2013.01); *B65H 29/12* (2013.01); *B65H 45/14* (2013.01); *B65H 45/142* (2013.01); *B65H 2301/3411* (2013.01); *B65H 2404/2531* (2013.01); *B65H 2404/2561* (2013.01); *B65H 2404/2611* (2013.01); *B65H 2701/18271* (2013.01); *B65H 2701/1932* (2013.01)

(58) Field of Classification Search
CPC ..... B31F 1/0019; B65H 29/12; B65H 45/04; B65H 45/14; B65H 45/142; B65H 2301/3411; B65H 2301/452; B65H 2404/2531; B65H 2404/2611; B65H 2404/2561; B65H 2701/18271; B65H 2701/1932
USPC ..... 271/225; 493/442
See application file for complete search history.

(56) References Cited

U.S. PATENT DOCUMENTS 4,571,234 A 2/1986 Labombarde
4,955,965 A 9/1990 Mandel
(Continued)

FOREIGN PATENT DOCUMENTS

DE 1436596 A1 3/1969
DE 3916254 A1 11/1990

OTHER PUBLICATIONS

Partial European Search Report, corresponding European Application No. 15163672.7, dated Sep. 17, 2015.
(Continued)

*Primary Examiner* — Robert F Long
*Assistant Examiner* — Xavier A Madison
(74) *Attorney, Agent, or Firm* — Marshall, Gerstein & Borun LLP

(57) ABSTRACT

A system for making a sheet of paper into a folded article is disclosed that includes multiple folding units and a turn unit for changing the travel path of the folded article. At least one of the folding units creates a fold in the folded article in a direction that is perpendicular to a fold created by another one of the folding units. The turn unit alters the travel direction of the folded article so that downstream folding units can be arranged in a manner that saves floor space. Also disclosed herein is a method of folding a sheet of paper that includes conveying the sheet of paper along perpendicular travel paths after the sheet of paper has been folded.

20 Claims, 14 Drawing Sheets

(51) Int. Cl.
*B65H 29/12* (2006.01)
*B65H 45/14* (2006.01)

(56) References Cited

U.S. PATENT DOCUMENTS

| | | | | |
|---|---|---|---|---|
| 5,004,220 | A | 4/1991 | Dreschel et al. | |
| 5,056,772 | A | 10/1991 | Kellum, III | |
| 5,224,696 | A | 7/1993 | Kellum, III | |
| 5,641,158 | A | 6/1997 | Gelb, Jr. et al. | |
| 6,689,040 | B2 | 2/2004 | Ifkovits et al. | |
| 7,887,050 | B2 | 2/2011 | Trudeau et al. | |
| 8,322,713 | B2 | 12/2012 | Oota et al. | |
| 2004/0164483 | A1* | 8/2004 | Focke | B65B 61/20 271/264 |
| 2005/0110208 | A1* | 5/2005 | Nilsson | B65H 29/12 271/184 |
| 2010/0032894 | A1* | 2/2010 | Trudeau | B65H 29/12 271/225 |
| 2010/0069214 | A1* | 3/2010 | Neubauer | B42D 15/008 493/421 |
| 2012/0298484 | A1 | 11/2012 | Gadliger | |

OTHER PUBLICATIONS

MV-11 Outsert Systems brochure, G&K-Vijuk Intern. Corp. (Jun. 2012).

* cited by examiner

SYSTEM AND METHOD FOR MAKING A FOLDED ARTICLE

FIELD OF THE DISCLOSURE

The present disclosure generally relates to a system for folding a sheet having information printed thereon, and more particularly, to a system in which a sheet of paper is fed through multiple folding units arranged adjacent one another to impart the sheet of paper with multiple folds, some of which extend in different directions.

BACKGROUND

A pharmaceutical container (e.g., a bottle of pills) is typically accompanied by a folded sheet of paper having printed information pertaining to the use and contents of the drug or other pharmaceutical product inside the container. The folded sheet of paper, commonly referred to as an outsert, may be adhered to the top or side of the pharmaceutical container, or alternatively, placed within a cardboard box used to package the pharmaceutical container. A consumer may unfold the outsert after purchasing the pharmaceutical container to read the printed information and learn about the benefits and risks associated with taking the drug.

Government regulations require the outserts for some drugs to set forth a significant number of warnings and other information. Consequently, in some cases, the sheet of paper used to make the outsert may be very large and may have multiple folds, in several different directions, so that it is small enough to be attached to the exterior of the pharmaceutical container and/or fit within the box carrying the pharmaceutical container. Forming the outsert may therefore require a number of different folding units, each folding unit imparting the sheet of paper with a different type of fold, and with some of the folds being perpendicular to each other. The folding units are typically arranged adjacent one another other along an assembly line such that adding more folding units increases the overall length of the assembly line. Generally, the more times a sheet of paper is folded, the more difficult it is to create each successive fold. Thus, downstream folding units may have to be separated by a pressing unit to help flatten the previous fold before the sheet of paper passes to the next folding section. The inclusion of pressing units further increases the length of the assembly line. Additionally, due to the difficulty of forming an additional fold in sheet of paper having many folds, the downstream stream folding units may only create a single fold in the sheet paper. Accordingly, many folding units may be needed to fold the sheet of paper multiple times.

FIG. 1 illustrates a top view of a known folding system 100 including, in the following order, a sheet feeder 110, a scoring unit 112, a folding unit 114, a variable speed transfer unit 116, a folding unit 118, a folding unit 120, a pressing unit 122, a folding unit 124, a pressing unit 126, a folding unit 128, a pressing unit 130, and a vertical stacker delivery unit 132. The folding unit 114 creates a plurality of parallel folds (e.g., a fan fold) in a direction perpendicular to the folds created by the folding unit 118. To accommodate this change in folding direction and to avoid having to re-orient the folded sheet before entering the folding unit 118, the folding system 100 inherently includes a 90 degree turn between the folding unit 114 and the folding unit 118. As a result, the folding system 100 has an L-shape, and thus requires a significant amount of floor space. In some instances, the footprint area enclosed by the folding system 100 (i.e., the total length L of the folding system 100 times the total width W of the folding system 100) may exceed 500 square feet. In addition to the inherent L-shape of the folding system 100, it is common for the folding system 100 to reside within boxes surrounded by fencing. This to help ensure that only a single type of informational item is being processed by the folding system 100 at any given time and to minimize mixing of different informational items. The known folding system 100 and any needed fencing therefore occupies a relatively large amount of valuable factory floor space. Moreover, its L-shape makes it difficult to compactly arrange the folding system 100 amongst other machines. Still further, the L-shape of the folding system 100 requires the operator to walk significant distances between the different processing units when operating and/or performing maintenance on the folding system 100. The layout of the folding system 100 can thus have a negative impact on the operator's efficiency.

SUMMARY

One aspect of the present disclosure includes a system that forms informational items having information printed thereon. The system includes a first folding unit, a second folding unit, a turn unit, and a third folding unit. The first folding unit is configured to form a first folded article from a sheet of paper having information printed thereon. The first folding unit defines a first linear travel path for the sheet of paper and possesses a plurality of folding rollers configured to form the sheet of paper into the first folded article by making a plurality of folds parallel to a first folding direction in the sheet of paper. The second folding unit defines a second linear travel path that is perpendicular to the first linear travel path and is operatively coupled downstream of the first folding unit to receive the first folded article. The second folding unit is configured to form a second folded article by making at least one fold in the first folded article parallel to a second folding direction that is perpendicular to the first folding direction. The turn unit is operatively coupled downstream of the second folding unit to receive the second folded article. The turn station defines an inlet disposed on a third linear travel path that is coextensive with the second linear travel path and an outlet disposed on a fourth linear travel path that is perpendicular to the second and third travel paths such that the turn station receives the second folded article from the second folding unit through the inlet and conveys the second folded article along the third linear travel path to the fourth linear travel path to the outlet. The third folding unit defines a fifth linear travel path that is coextensive with the fourth linear travel path and is operatively coupled to the turn unit to receive the second article. The third folding unit is configured to form a third folded article by making at least one fold in the second article parallel to the second folding direction.

Another aspect of the present disclosure provides a system for folding a sheet that includes a first folding unit, a second folding unit, and a turn unit. The first folding unit is configured to convey the sheet along a first travel path and includes a first plurality of folding rollers to form a plurality of folds in the sheet, with each of the folds being parallel to a first folding direction. The second folding unit is arranged downstream of the first folding unit and is configured to convey the sheet along a second travel path that is perpendicular to the first travel path. The second folding unit includes a second plurality of folding rollers to form at least one fold in the sheet in a second folding direction that is perpendicular to the first folding direction. The turn unit is arranged downstream of the second folding unit. The turn unit includes an inlet positioned along a third travel path that is parallel to the second travel path, an outlet positioned along a fourth travel path that is transverse to the third travel path, and a conveyor configured to convey the sheet from the inlet to the outlet.

A further aspect of the present disclosure provides a method of folding a sheet of paper having information printed thereon. The method includes conveying the sheet of paper along a first travel path, forming a plurality of folds in the sheet of paper, each of the folds being parallel to a first folding direction, conveying the sheet of paper along a second travel path that is perpendicular to the first travel path, and forming at least one fold in the sheet of paper in a second folding direction that is perpendicular to the first folding direction. The method also includes conveying the sheet of paper along a third travel path that is parallel to the second travel path while rotating the sheet of paper in a first rotational direction, and conveying the sheet of paper along a fourth travel path that is perpendicular to the third travel path while rotating the sheet of paper in a second rotational direction that is opposite to the first rotational direction.

DETAILED DESCRIPTION

Figure 2:
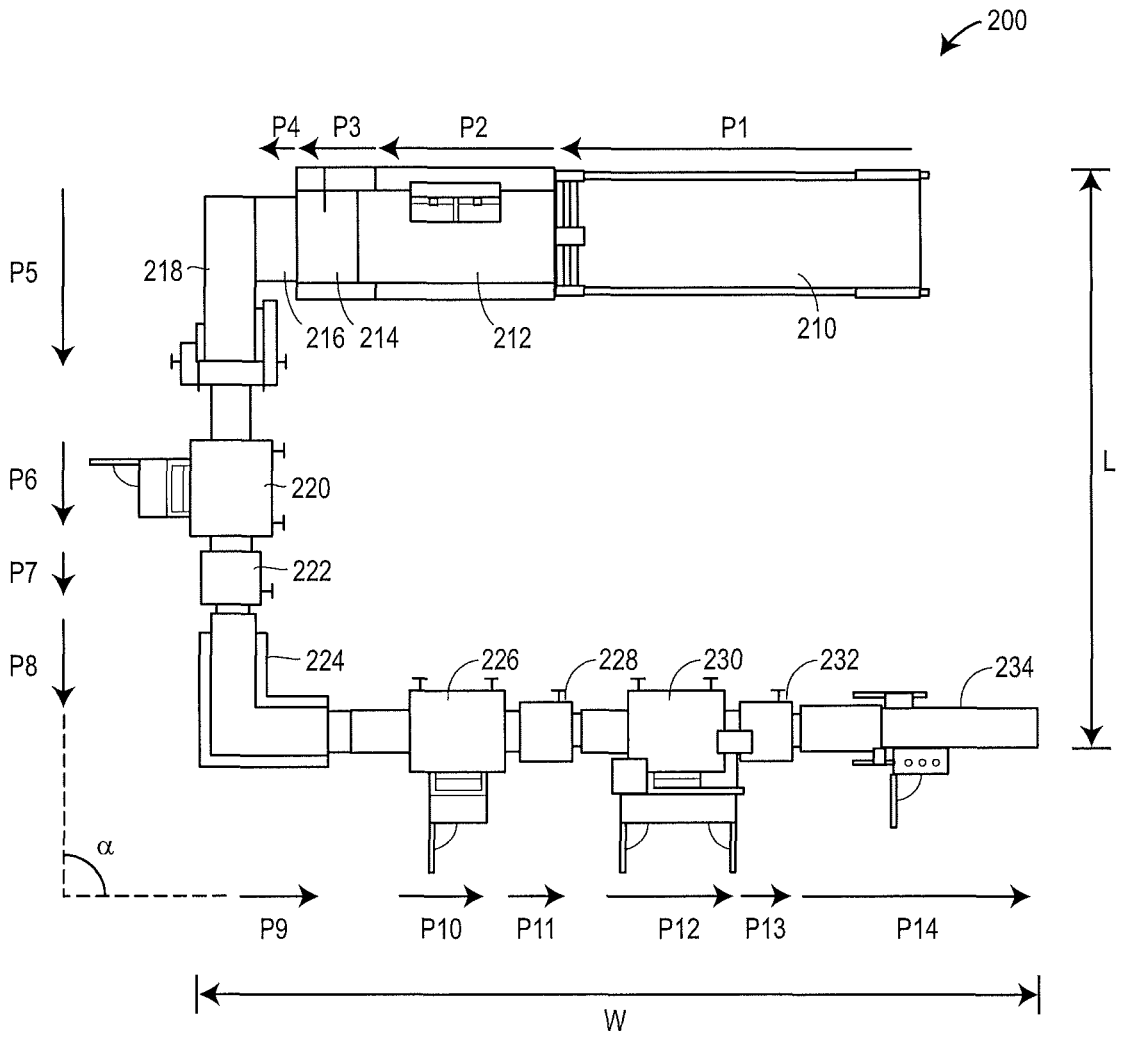
FIG. 2 is a top view of one embodiment of a folding system of the present disclosure.

FIG. 2 illustrates one possible embodiment of a folding system 200 which can be used to prepare an informational item such as an outsert from a sheet of paper S in accordance with principles of the present disclosure. Referring to FIG. 2, the folding system 200 may include multiple processing units arranged adjacent one another including, but not limited to, a sheet feeder 210, a scoring unit 212, a folding unit 214, a variable speed transfer unit 216, a folding unit 218, a folding unit 220, a pressing unit 222, a turn unit 224, a folding unit 226, a pressing unit 228, a folding unit 230, a pressing unit 232, and a vertical stacker delivery unit 234. While the turn unit 224 in FIG. 2 is positioned after the folding unit 220 and before the folding unit 226, this is just one example of where the turn unit 224 could be positioned. The turn unit 224 could alternatively be positioned after the folding unit 218 and before the folding unit 220, or after the folding unit 226 and before the folding unit 230, or after the folding unit 230 and before the vertical stacker delivery unit 234. Thus, it should be appreciated that the turn station 224 provides for a versatile and flexible folding system 200. Additionally, while the folding system 200 depicted in FIG. 2 includes three folding units 220, 226, and 230 (and corresponding pressing units 222, 228, 232) located downstream of folding unit 218, other folding systems 200 in accordance with the present disclosure could have only one or two of the folding units 220, 226, and 230 (and corresponding pressing units 222, 228, 232) located downstream of the folding unit 218.

Turning now to the general operation of the folding system 200—the sheet of paper S is provided by the sheet feeder 210 to the scoring unit 212 which creates a plurality of non-cutting score lines in the sheet of paper S in locations that coincide with positions at which at least some of the subsequent folds are to be formed. The sheet of paper S is then automatically conveyed to the folding unit 214 which makes a plurality of folds in a first folding direction. The sheet of paper S, which at this point takes the shape of a folded article, is then conveyed by the variable speed transfer unit 216 to the folding unit 218, which may make one or more cross-folds in a second folding direction perpendicular to the first folding direction. The folded article exits the folding unit 218 and is passed through the folding unit 220 which creates at least one additional fold in the second folding direction. Next, the folded article passes through the pressing unit 222 (e.g., spring-activated press) in order to flatten the folded article and thereby make it easier to perform subsequent folding.

After exiting the pressing unit 222, the folded article enters the turn unit 224. The turn unit 224 changes the traveling path of the folded article such that the folded article exits the turn unit 224 along a traveling path that differs from the traveling path along which the folded article enters the turn unit 224. As described below in more detail, the turn unit 224 may effect an approximately (e.g., ±25%) 90 degree change in direction of the folded article. Subsequently, the folded article passes through the folding unit 226 which imparts an additional fold to the folded article in the second folding direction, then through the pressing unit 228, through the folding unit 230, through the pressing unit 232, and into the vertical stacker delivery unit 234.

Figure 1:
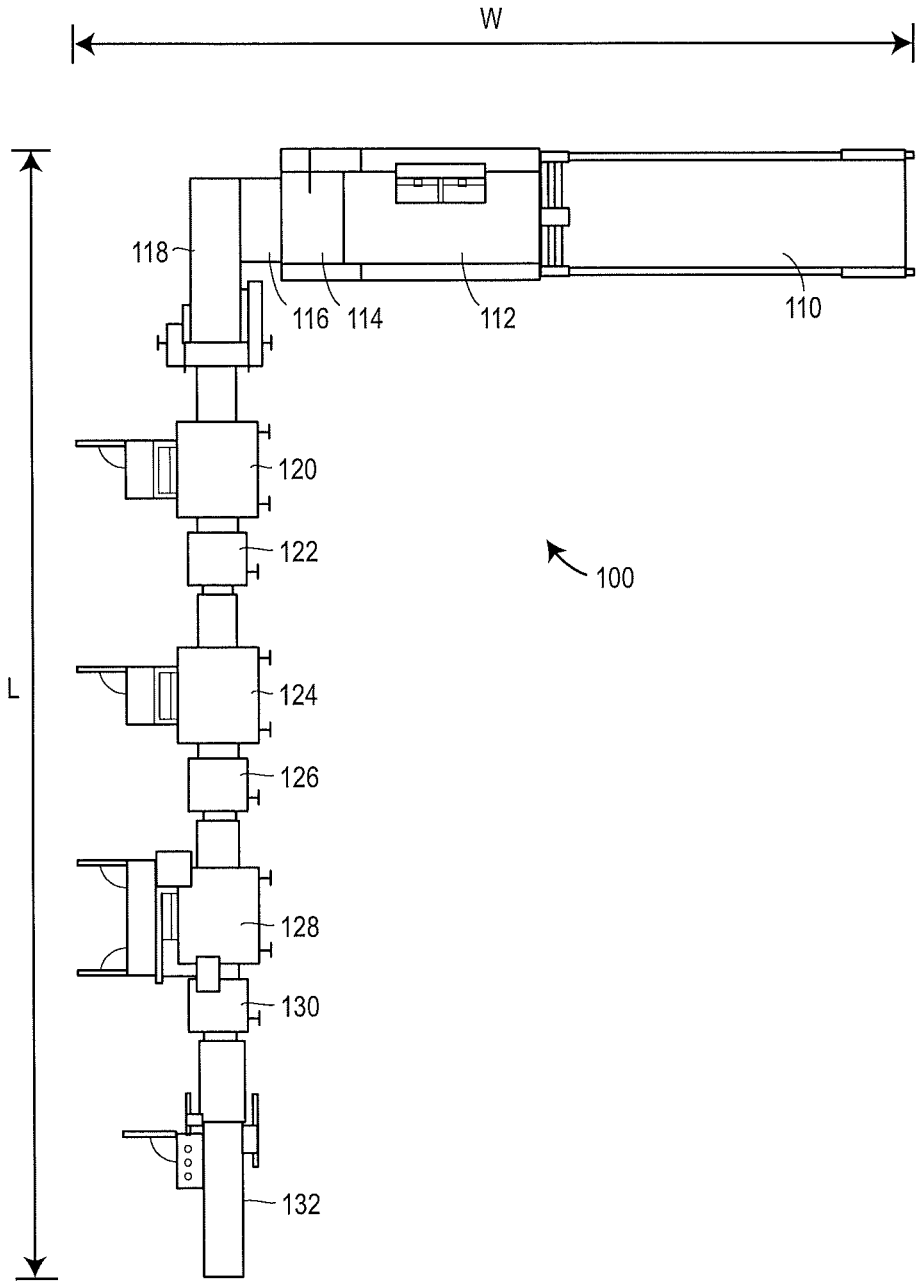
FIG. 1 is a top view of a known folding system.

So configured, the folding system 200 and method of the present disclosure advantageously provide an arrangement of processing units that helps minimize the amount of floor space needed to accommodate the folding system 200. The inclusion of at least one turn unit makes it possible to arrange the folding system 200 in a variety of different layouts including, for example, a U-shaped layout and a Z-shaped layout, which can help reduce the amount of floor space enclosed by the folding system 200 and/or enable a more compact arrangement of the folding system 200 with other folding systems and machines on the factory floor. In one embodiment of the U-shaped layout of the folding system 200, the total footprint area enclosed by the folding system (i.e., the total length L of the folding system 200 times the total width W of the folding system 200) is approximately (e.g., ±25%) 300 square feet, which may represent about a 40% savings in floor space as compared to the L-shaped layout depicted in FIG. 1. Additionally, the layout of the folding system may decrease the walking distance between the upstream and downstream portions of the folding system, thus increasing the efficiency of an operator who must attend to the different processing units during operation of the folding system 200 and/or perform maintenance on the folding system.

Each of the foregoing components of the folding system, and the methods of folding the sheet of paper, will now be described in more detail. Although the following text describes various embodiments of various processing units that may be used in connection with the folding system of the present disclosure, the claims of this application are not limited to the particular embodiments described below.

Sheet Feeder 210

Figure 3A:
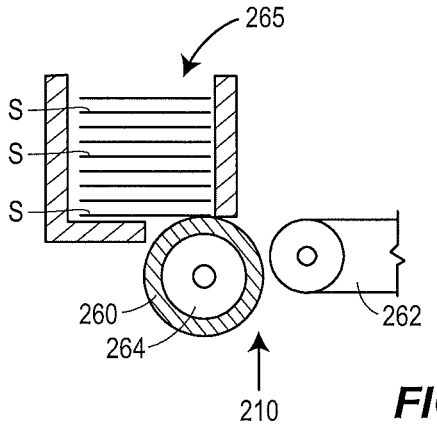
FIGS. 3A, 3B, and 3C illustrate schematic side views of the sheet feeder 210 depicted in FIG. 2.
Figure 3B:
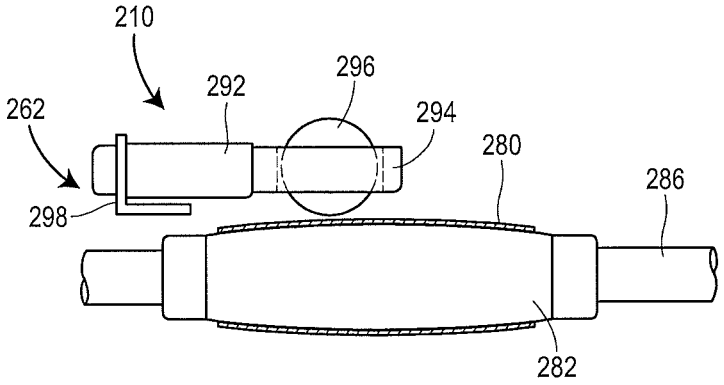
Figure 3C:
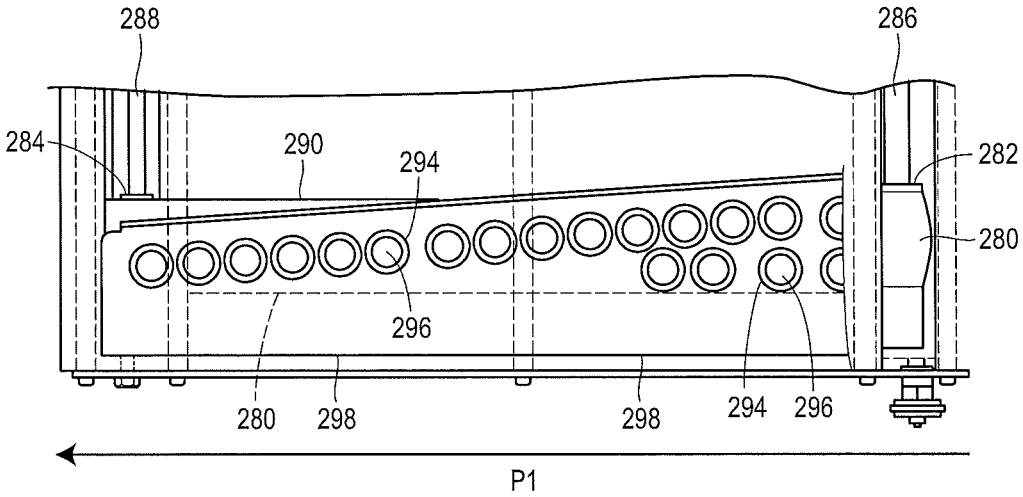

FIGS. 3A, 3B, and 3C illustrate one possible embodiment of the sheet feeder 210 shown schematically in FIG. 8A. Referring to FIG. 3A, the sheet feeder 210 may include a vacuum drum or roll 260 and a conveyor 262. The vacuum roll 260 may be configured as a cylindrical drum having a hollow interior 264 and a plurality of holes formed in its cylindrical outer surface. A vacuum pump (not illustrated) in fluid communication with the hollow interior 263 is provided to create pneumatic suction at the holes in the cylindrical outer surface of the vacuum roll 260. This suction enables the vacuum roll 260 to be controlled to remove the lowermost sheet of paper S from a stack 265 of sheets of paper S.

FIGS. 3B and 3C illustrate an example of the structure of the conveyor 262 of the sheet feeder 210. The conveyor 262 may possess a conveyor belt 280 that conveys the sheets of paper S generally along a linear travel path P1. The conveyor belt 280 is driven by a pair of spaced rollers 282, 284, each of which may be rotatably driven by a respective drive rod 286, 288. The conveyor 262 may also include a sheet alignment mechanism 290 positioned directly over the conveyor belt 280. The alignment mechanism 290 may include a retainer arm 292 having a plurality of cylindrical bores 294 formed therein, a respective metal ball 296 positioned within each of the bores 294, and an L-shaped side guide 298 connected to the retainer arm 292.

Sheets of paper S from the stack 265, which may be formed by an upstream accumulator unit (not illustrated), may be periodically and individually fed by the vacuum roll 260 to the conveyor 262 so that they pass between the bottom of the metal balls 296 and the top of the conveyor belt 280. The weight of the metal balls 296 resting on top of the sheets of paper S may help maintain the alignment of the sheets relative to the conveyor belt 280. As shown in FIG. 9B, the side guide 298 may be angled slightly relative to the conveyor belt 280. As a result, as the sheets of paper S pass through the conveyor 262 (from right to left in FIG. 3C), the side edges of the sheets may gradually be moved against the edge of the side guide 298 to cause the side edges of the sheets to become justified or flush against the side guide 298 for proper alignment as the sheets enter the scoring unit 212.

Further details regarding the design and operation of a sheet feeder that can be used for the sheet feeder 210 are disclosed in U.S. Patent Application Publication No. 2007/0126228, which is hereby incorporated by reference.

Scoring Unit 212

In one embodiment, the scoring unit 212 is located downstream of the sheet feeder 210 and upstream of the folding unit 214. The scoring unit 212 is configured to create non-cutting score lines in the sheet of paper S while the sheet of paper S is conveyed along travel path P2. The positions of the score lines coincide with the positions at which subsequent folds are to be made by at least some of the downstream folding units. The scoring unit 212 may include, for example, an upper and lower scoring assembly, with each such assembly including a plurality of non-cutting, scoring disks mounted on a rod at spaced-apart locations. In addition to the scoring disks, or as an alternative to the scoring disks, the scoring unit 212 may include high pressure water nozzles that create non-cutting, scoring lines in the sheet of paper S.

Folding Unit 214

The folding unit 214 is configured to make one or more folds parallel to a first folding direction in the sheet of paper S. Each of the folds created by the folding unit 214 may be parallel to an edge of the sheet of paper S having the greatest (or the least) length. While the sheet of paper S of paper may move in a zigzag motion through the rollers of the folding unit 214, the sheet of paper S generally moves along a linear travel path P3 through the folding unit 214. In one embodiment, the travel path P3 is parallel and/or coextensive with the travel paths P1 and P2.

Figure 4A:
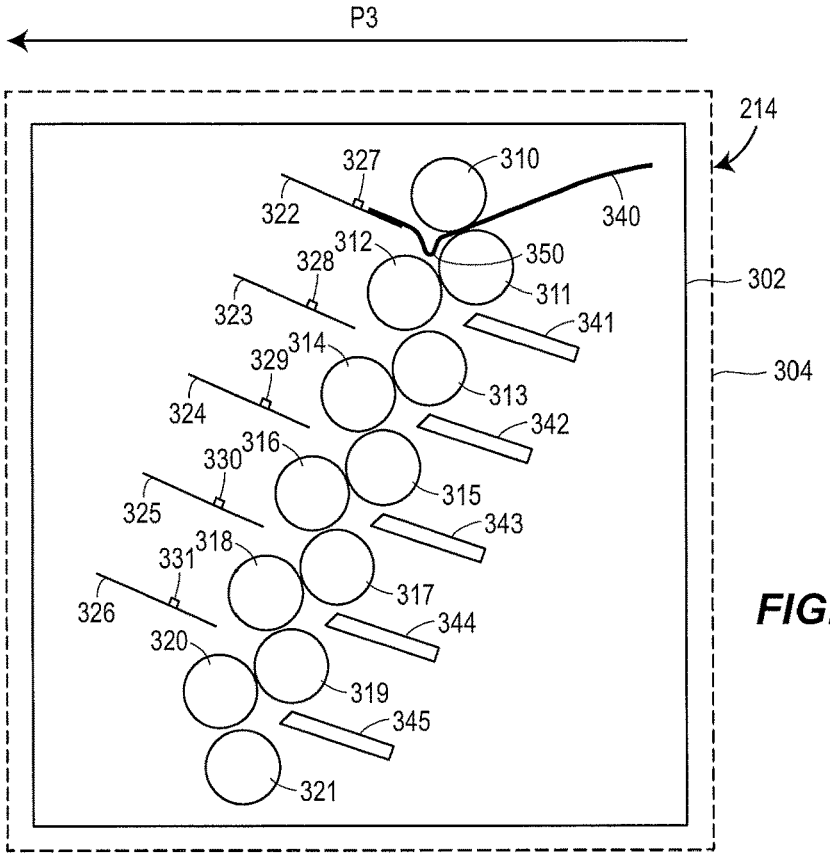
FIGS. 4A and 4B depict schematic side views of the folding unit 214 depicted in FIG. 2.
Figure 4B:
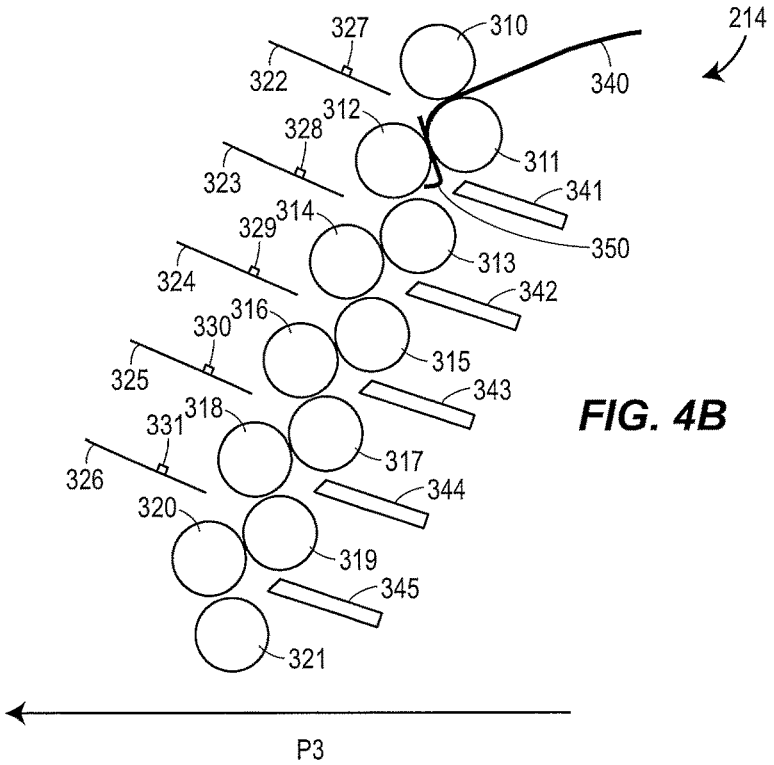

FIGS. 4A and 4B illustrate schematic side views of one possible embodiment of the folding unit 214. As illustrated in FIG. 4*a*, the folding unit 214 may be provided with a pair of spaced apart frame members 302, 304 (which are not illustrated in FIG. 4B), a plurality of cylindrical folding rollers 310-321 rotatably supported between the members 302, 304, a plurality of folding plates 322-326, and a plurality of deflectors 341-345. The folding rollers 31-321 may have non-smooth, knurled or abraded surfaces to facilitate gripping of the sheet of paper S. The plurality of folding plates 322-326 include a plurality of stops 327-331 positioned to stop the leading edge or a portion of the sheet of paper P passing through the folding unit 214 at predetermined locations. Each of the deflectors 341-345 causes the leading edge or portion of the article 340 passing through the folding unit 210 to be deflected towards the next pair of folding rollers.

The sheet of paper S may enter folding unit 214 as an unfolded sheet. Initially, the leading edge of the sheet of paper S passes through the nip between rollers 310 and 311 and hits the stop 327. This causes an intermediate portion 350 of the sheet of paper S to be forced downwardly towards the nip between the folding rollers 311 and 312. A fold is created in the sheet of paper S when the intermediate portion 350 passes through the nip between the folding rollers 311 and 312. Next, as illustrated in FIG. 4B, the end of the deflector 341 deflects the intermediate portion 350 towards the nip between rollers 312 and 313.

This process may continue in a similar fashion until all of the desired folds in the first folding direction are made in the sheet of paper S. The folding unit 214 illustrated in FIGS. 4A and 4B would make five folds in the first folding direction in the sheet of paper S. The number of folds and the positions at which they are made can be varied by changing the number and/or positions of the folding rollers 310-321, the folding plates 322-326, and the deflector plates 341-345. Upon exiting the folding unit 214, the sheet of paper S takes the form of a folded article 370.

U.S. Patent Application Publication No. 2007/0126228, which is incorporated by reference, describes additional details regarding the design and operation of a folding unit that can be used for the folding unit 214.

Variable Speed Transfer Unit 216

The variable speed transfer unit 216, located downstream of the folding unit 214 and upstream of the folding unit 218, transfers the folded article 370 from the folding unit 214 to the folding unit 218. The variable speed transfer unit 216 may include opposing conveyor belts (not illustrated) which grip the folded article 370 therebetween and transport the folded article 370 along a linear travel path P4. The conveyor belts may be driven by a controllable motor so that the speed at which the variable speed transfer unit 216 transports the folded article 370 is adjustable.

Folding Unit 218

The folding unit 218 is configured to make one or more folds in a second folding direction perpendicular to the first folding direction in which the initial folds were made by the folding unit 214. The folding unit 218 may be located downstream of the variable speed transfer unit 216 to receive the folded article 370 from the variable speed transfer unit 216. The folded article 370 generally moves along a linear travel path P5 as it passes through the folding unit 218. The travel path P5 is perpendicular, or otherwise transverse, to the travel path P3 of the folding unit 216.

Figure 5A:
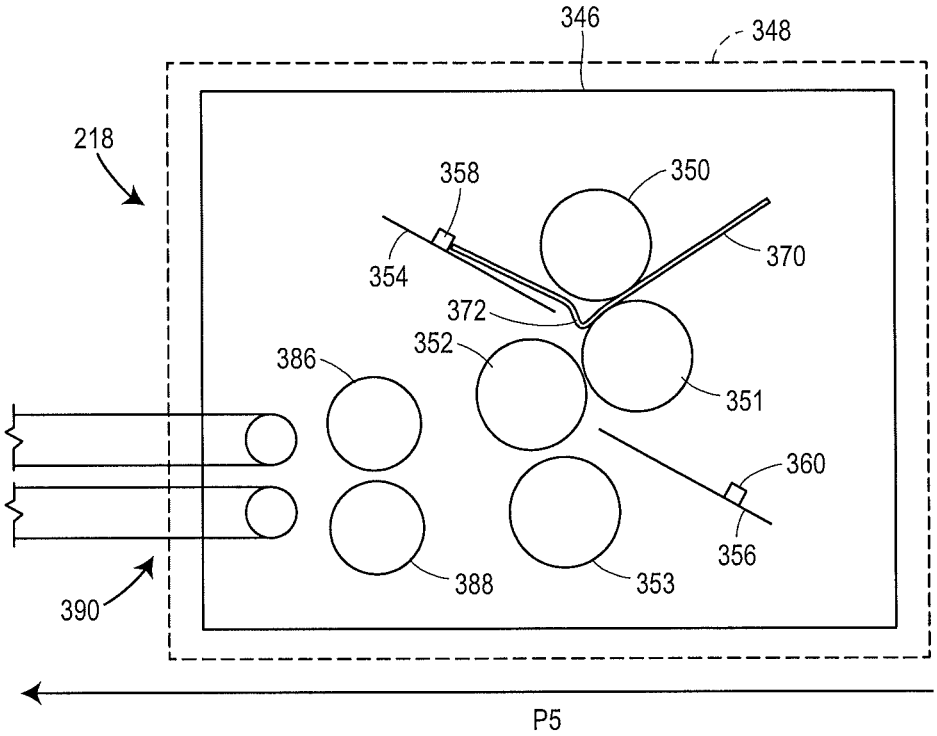
FIGS. 5A-5D are schematic side views of the folding unit 218 of FIG. 2.

One possible embodiment of the folding unit 218 is illustrated in FIGS. 5A-5D. Referring to FIG. 5A, the folding unit 218 may include a pair of spaced-apart frame members 346, 458 (not depicted in FIGS. 5B-5D), a plurality of cylindrical folding rollers 350-353 rotatably mounted between the frame members 346, 348, and a pair of folding plates 354, 356. The folding plates 354, 356 may be provided, respectively, with stops 358, 360 positioned to stop the leading edge or a portion of the fold article 370 passing through the folding unit 218 at predetermined locations.

As shown in FIG. 5A, upon entry into the folding unit 218, the leading edge of the folded article 370 passes through the nip between rollers 350 and 351 and hits the stop 358. This causes an intermediate portion 372 of the folded article 370 to be forced downwardly towards the nip between rollers 351 and 352. A fold is created in the folded article 370, in the second folding direction perpendicular to the fold created by the folding unit 214, when the intermediate portion 372 passes through the nip between the rollers 351 and 352.

Figure 5B:
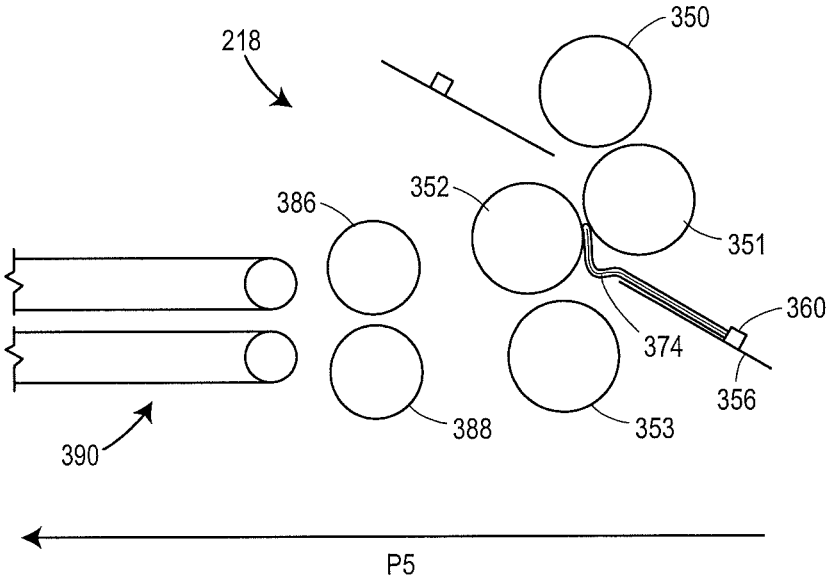
Figure 5C:
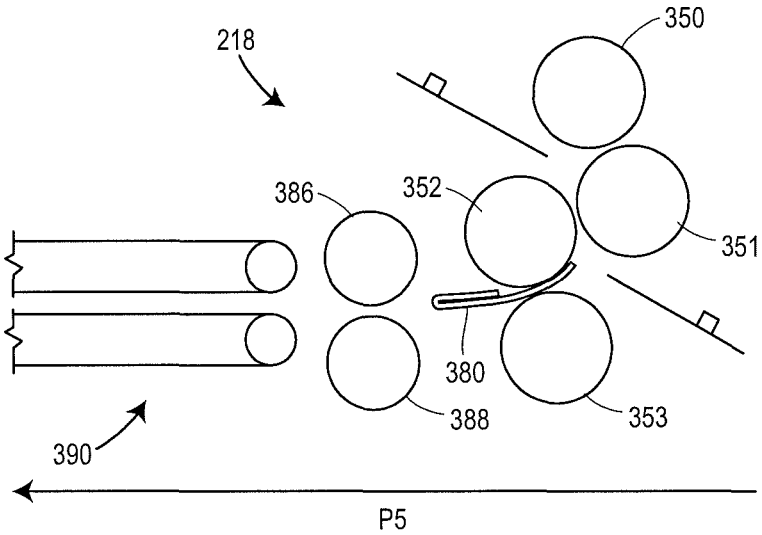
Figure 5D:
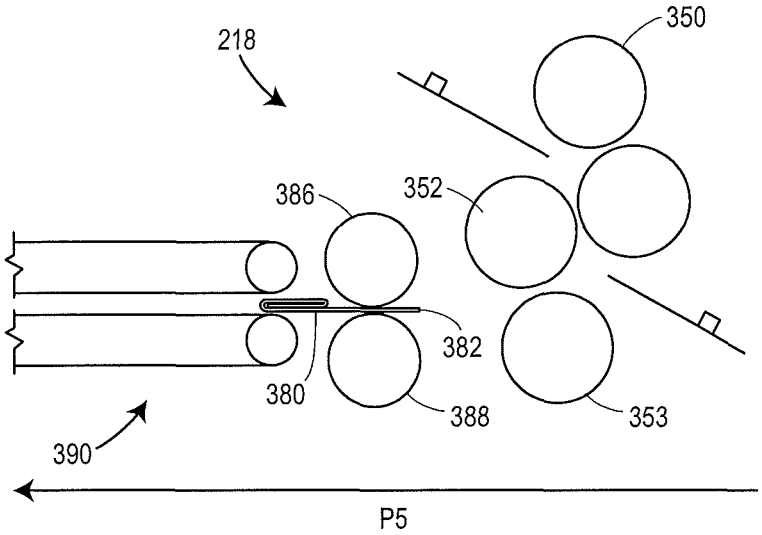

Next, as shown in FIG. 5B, the leading folded intermediate portion 372 moves along the folding plate 356 until it makes contact with the stop 360. As the rear portion of the folded article 370 continues to advance, an intermediate portion 374 of the folded article 370 buckles and moves downwardly towards the nip between the folding rollers 352 and 353. When the intermediate portion 374 passes between the folding rollers 352 and 353, it is folded by the folding rollers 352, 353, as illustrated in FIG. 5C, and thereby creates folded article 380. Then, as shown in FIG. 5D, the folded article 380 may passed through a pair of cylindrical flattening rollers 386 and 388 and then to a conveyor 390.

Further details regarding the design and operation of a folding unit that can be used for the folding unit 218 are disclosed in U.S. Patent Application Publication No. 2007/0126228, which is incorporated by reference.

Folding Unit 220

The folding unit 220 is configured to make at least one fold in the second folding direction (i.e., perpendicular to the first folding direction in which the initial folds were made by the folding unit 214). The folding unit 220 may be located downstream of the folding unit 218 to receive the folded article 380 from the folding unit 218. The folded article 380 generally moves along a linear travel path P6 as it passes through the folding unit 220. The travel path P6 is parallel and/or coextensive with the travel path P5.

Figure 6A:
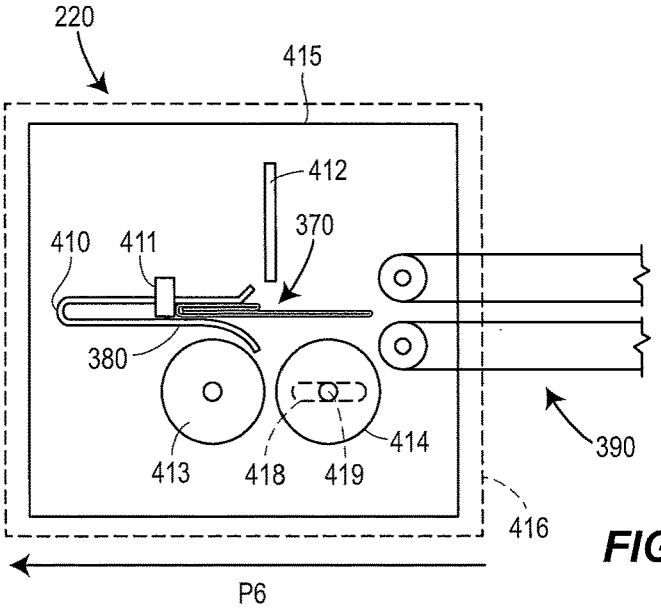
FIGS. 6A and 6B are schematic side views of the folding unit 220 shown in FIG. 2.
Figure 6B:
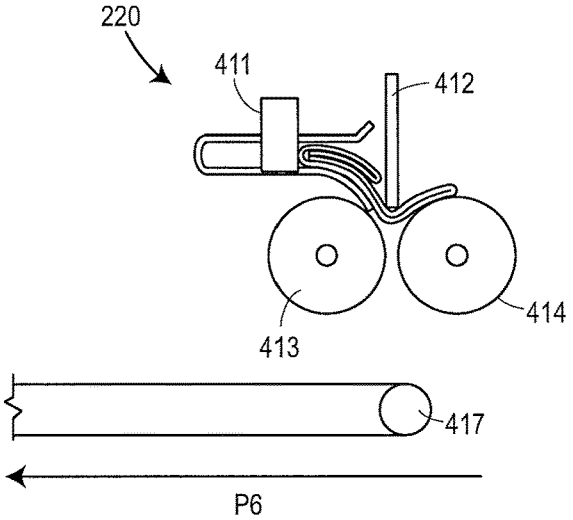

FIGS. 6A and 6B are side views of one possible embodiment of the folding unit 220. The folding unit 220 may be provided with a guide member 410, a stop member 411 associated with the guide member 410, a linearly translatable deflection or knife member 412, a pair of cylindrical folding rollers 413, 414 rotatably mounted between a pair of spaced-apart frame members 415, 416, and a conveyor 417. Each of the frame members 415, 416 (or another support member coupled to the frame members 415, 416) may have a respective horizontally disposed aperture or slot formed 418 therein, and a support or axle portion 419 formed at each end of one of the folding rollers 413, 414 may be supported within the slot 418 to allow the spacing between the outer diameter of each of the folding rollers 413, 414 to be adjusted to accommodate the folding of articles of different thicknesses.

Referring to FIG. 6A, after the folded article 380 exits the conveyor 390, the leading edge of the folded article 380 may abut against the stop member 411. With the folded article 380 in that position, the bottom edge of the deflection member 412 may be positioned generally in the middle of the folded article 380.

With the folded article 380 so positioned, the deflection member 412 may be moved downwardly so that it makes contact with an intermediate portion of the folded article 380 and so that it pushes the intermediate portion towards the nip between the folding rollers 413 and 414, as depicted in FIG. 6B. As the folded article 380 passes through the folding rollers 413, 414, the article 380 may be folded, thereby becoming folded article 390. The folded article 390 may then be automatically conveyed by the conveyor 417 to the pressing unit 222.

Further details regarding folding units that could be used for the folding unit 220 are described in U.S. Patent Application Publication No. 2007/0126228, which is incorporated by reference.

Pressing Unit 222

Figure 7:
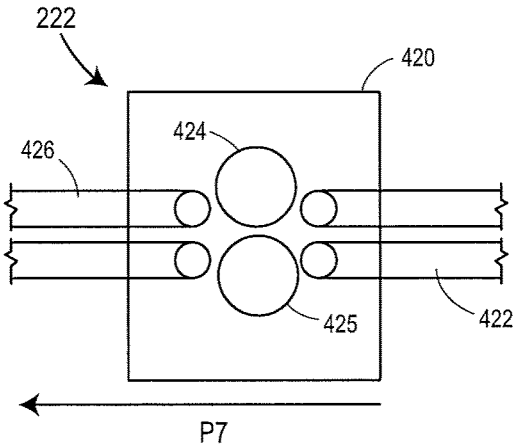
FIG. 7 illustrates a schematic side view of the pressing unit 222 of FIG. 2.

FIG. 7 illustrates one embodiment of the pressing unit 222. The pressing unit 222 may include a support structure 420, which may include a pair of spaced-apart frame members. The pressing unit 22 may have an entry conveyor 422 that receives the folded article 390 from the conveyor 417 of the folding unit 222. The pressing unit 222 may have a pair of upper and lower pressure rollers 424, 425 coupled to the support structure 420 so as to rotate in a fixed position. The upper pressure roller 424 may be rotatably supported by the support structure 420 so that the upper pressure roller 424 is slightly movable or adjustable in a vertical direction to accommodate folded articles of different thicknesses. One of the pressure rollers 424, 425 may be coupled to a pressure-setting mechanism, such as a spring mechanism (not shown in FIG. 7), to exert pressure on the folded article 390 as it passes through the nip between the pressure rollers 424, 425. Generally, the folded article 390 moves along linear travel path P7 as it is conveyed through the pressing unit 222.

In one embodiment, the pressure rollers 424, 425 may cause the folded article 390 passing through the pressing unit 222 to be subjected to a pressure that lies within any one of the following pressure ranges: a) 30-100 psi; b) 30-200 psi; c) 30-500 psi; d) 50-200 psi; or e) 50-500 psi. Passing the folded article 390 through the pressing unit 222 may make it easier for subsequent folding actions to take place, and/or may result in better folds being formed. Furthermore, passing the folded article 390 through the pressing unit 222 may make it easier to convey the folded article 390 through the turn unit 224 without becoming jammed.

U.S. Patent Application Publication No. 2007/0126228, which is incorporated by reference, describes further details about the design and operation of a pressing unit that could be used for the pressing unit 222.

Turn Unit 224

Figure 8:
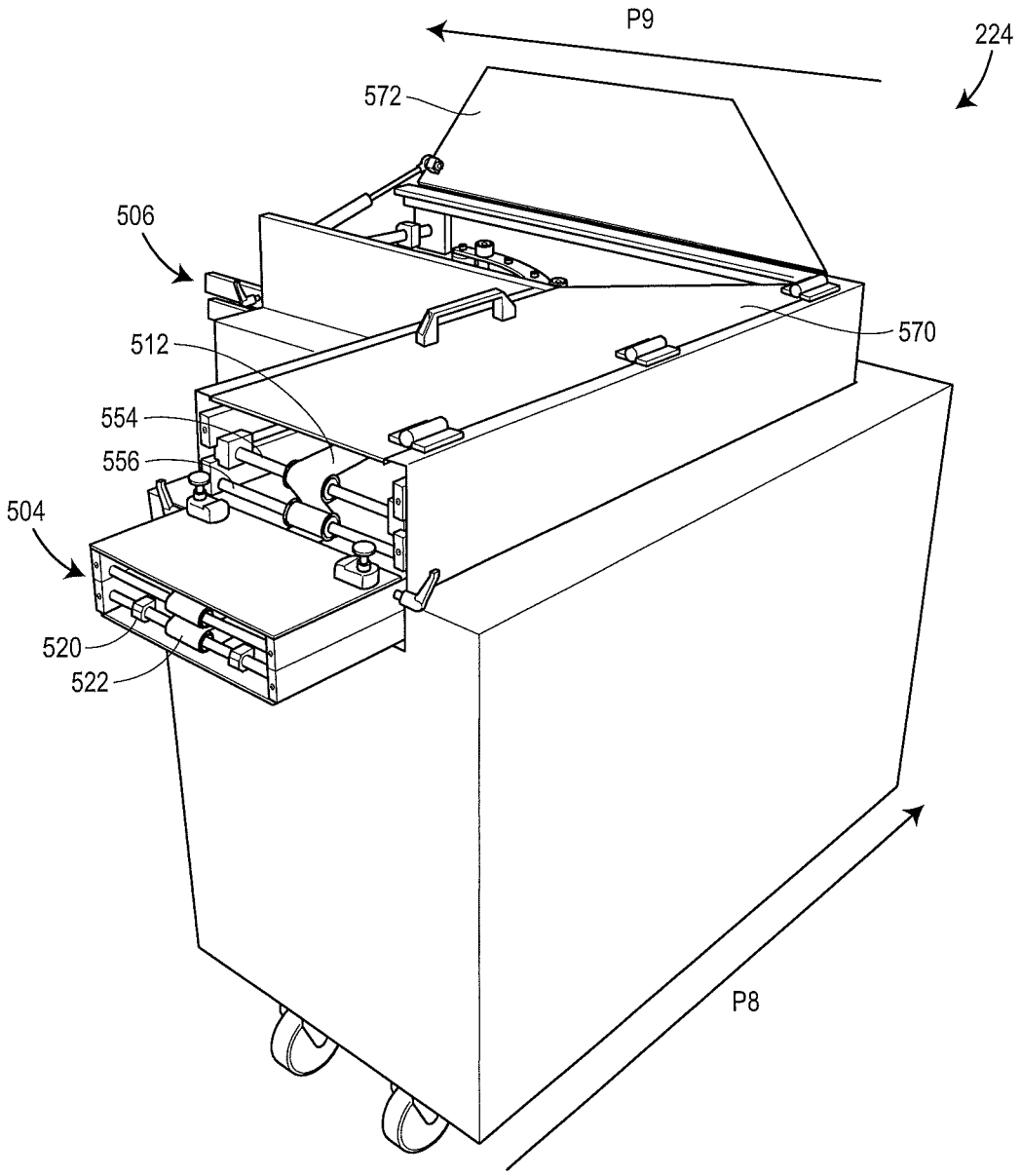
FIG. 8 depicts a perspective view of the input side of the turn unit 224 of FIG. 2.
Figure 9:
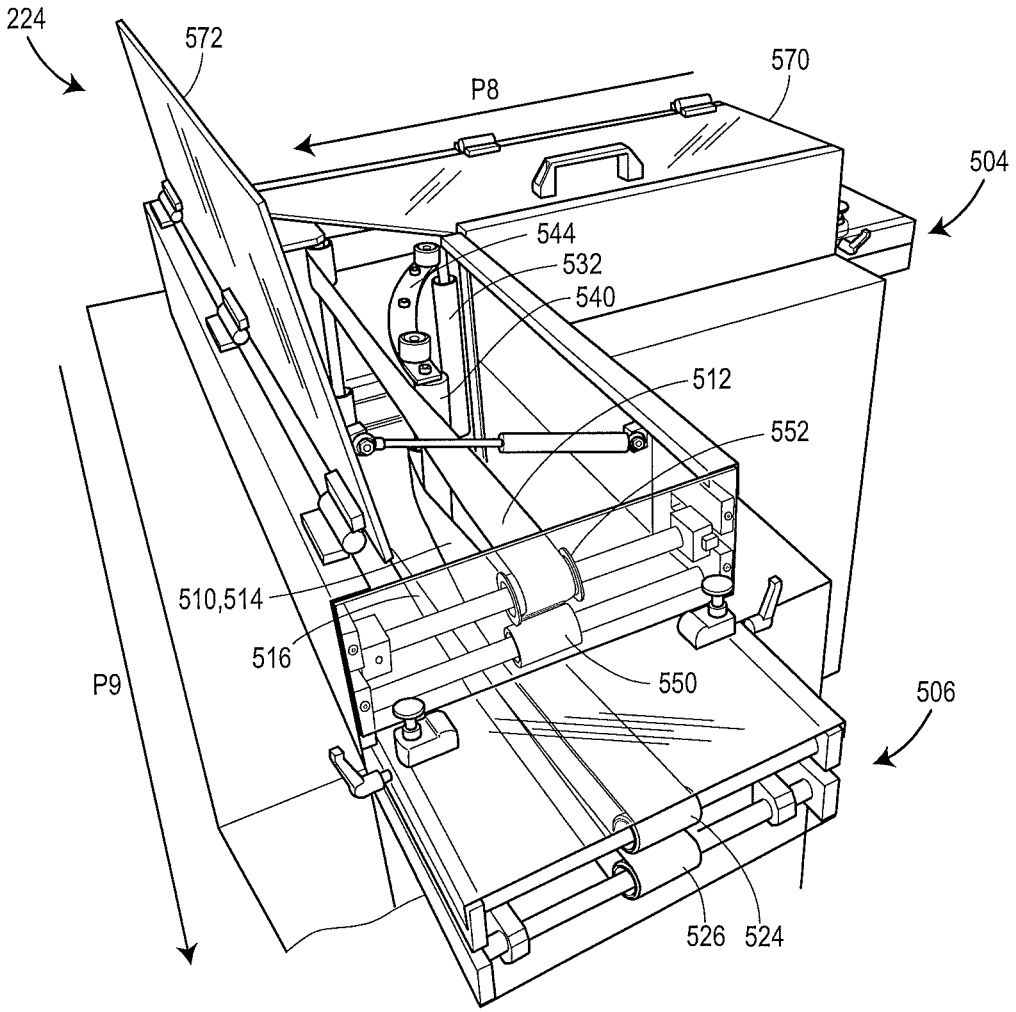
FIG. 9 is a perspective view of the output side of the turn unit 224 of FIG. 2.

FIGS. 8 and 9 illustrate perspective views of one possible embodiment of the turn unit 224. The turn unit 224 may employ two conveyor belts 500, 502 to convey the folded article 390 between an inlet 504 disposed along the travel path P8 and an outlet 506 disposed along the travel path P9. The travel paths P8 and P9 are transverse to each other such that an angle α is formed between the travel paths P8 and P9. In the illustrated embodiment, the travel paths P8 and P9 are perpendicular to each other and thus form an angle α of 90 degrees. In other embodiments, the angle α may be in a range of about 60 degrees to about 120 degrees, depending on the desired layout of the folding system 200. To redirect the folded article 390 from the travel path P8 to the travel path P9, the conveyor belts 500, 502 are bent around a curve, as discussed below in more detail.

Figure 10:
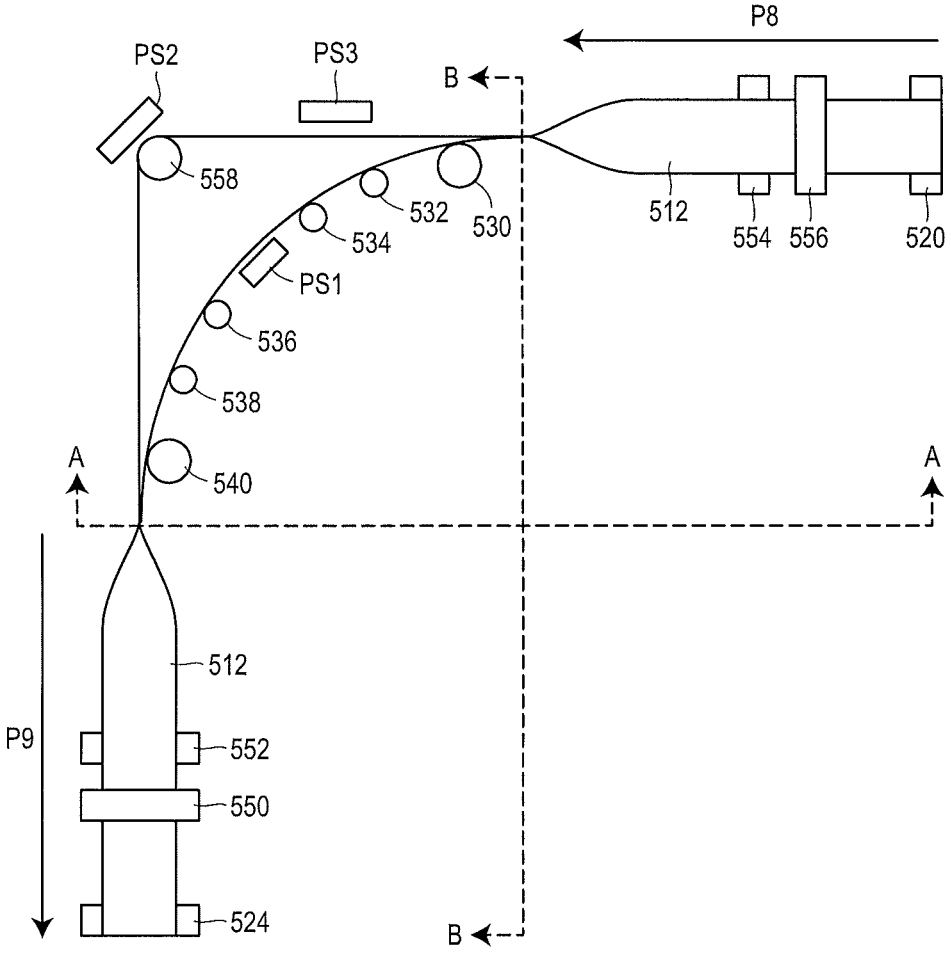
FIG. 10 is a schematic top view of the turn unit of FIGS. 8 and 9.
Figure 11:
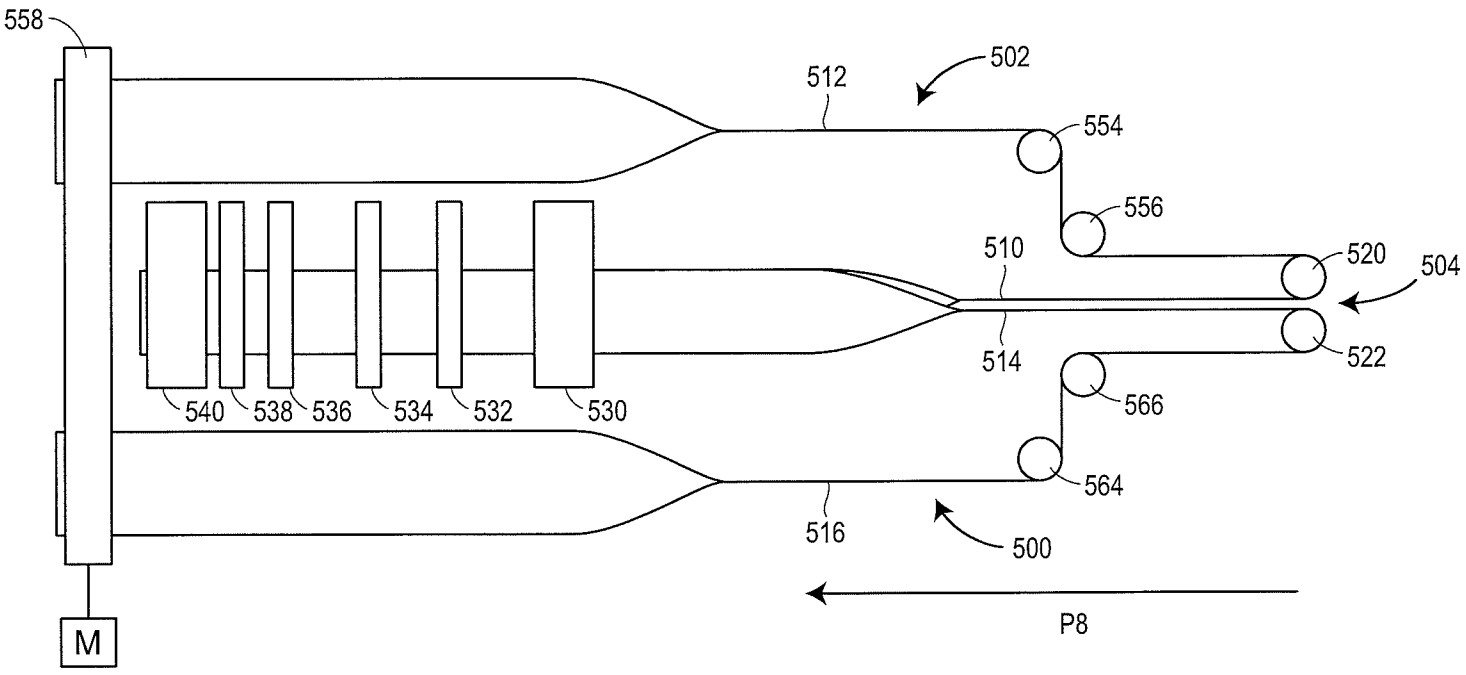
FIG. 11 is a cross-sectional view along line A-A of FIG. 10.
Figure 12:
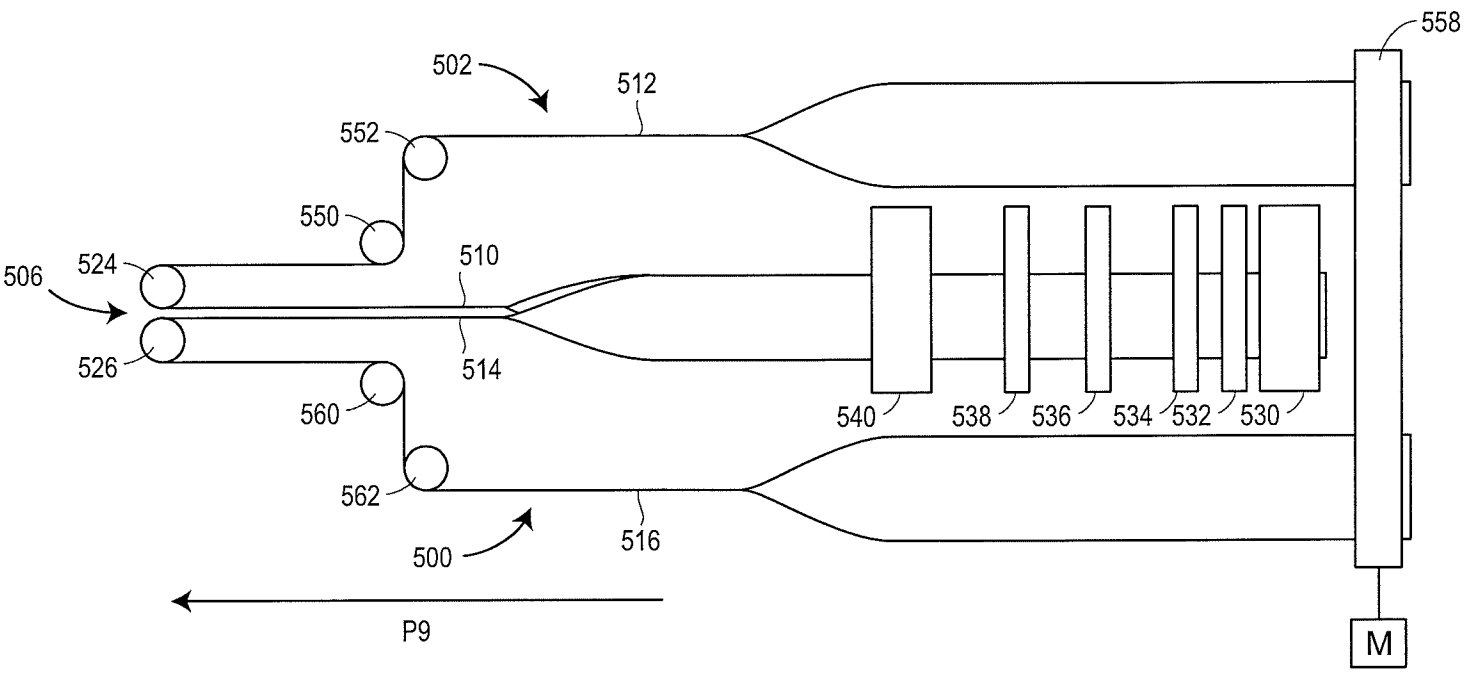
FIG. 12 is a cross-sectional view along line B-B of FIG. 10.

Referring to FIGS. 10-12, the conveyor belt 500 includes a transport belt segment 510 and a return belt segment 512 which together form an endless loop. Similarly, the conveyor belt 502 possesses a transport belt segment 514 and a return belt segment 516 forming an endless loop. The transport belt segment 510 is positioned in opposition to the transport belt segment 514 so that a surface the transport belt segment 510 faces a surface of the transport belt segment 514. In operation, the folded article 390 is squeezed and/or gripped between the transport belt segments 510, 514 so that the article 390 moves together with the transport belt segments 510, 514 through the interior of the input unit 224.

The inlet 204 of the turn unit 224 is formed by a pair of opposing inlet rollers 520, 522. As illustrated in FIG. 11, the conveyor belts 500, 502 are wrapped around the inlet rollers 520, 522, respectively, such that the transport belt segment 510 and the transport belt segment 514 pass between the inlet rollers 520, 522 and thereby form the mouth of the inlet 204. The outlet 506 of the turn unit 224 is formed by a pair of opposing outlet rollers 524, 526. FIG. 12 illustrates that the conveyor belts 500, 502 are wrapped around the outlet rollers 524, 526, respectively, such that the transport belt segment 510 and the transport belt segment 514 pass between the outlet rollers 524, 526 and thereby form the egress of the outlet 506. The spacing between the inlet rollers 520, 522 and/or the spacing between the outlet rollers 524, 526 may be adjustable to accommodate folded articles 390 of different thicknesses.

Figure 13:
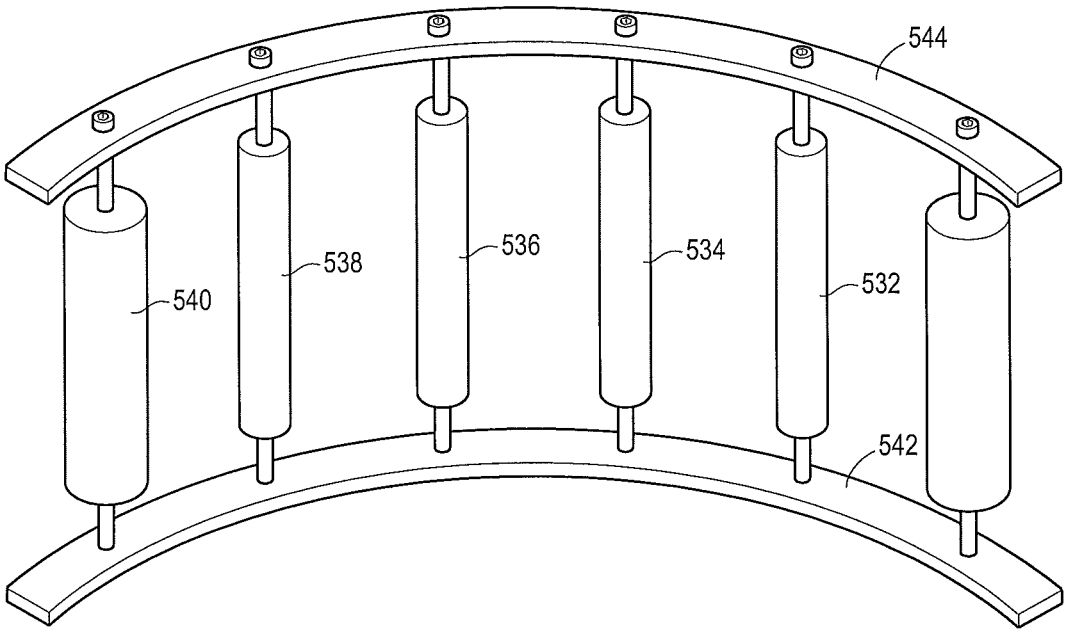
FIG. 13 is perspective view of the guide rollers 530-540 of FIG. 10.

To bend the transport belt segments 510, 514 and thus redirect the folded article 390 from the travel path P8 to the travel path P9, the transport belts segments 510, 514 are wrapped around an array of guide rollers 530-540, as illustrated in FIG. 10. The guide rollers 530-540 are positioned along curved support rails 542, 544, depicted in FIG. 13, to impart a curved shape to the transport belt segments 510, 514. The guide rollers 530, 540 located at the beginning and end of the curve may possess a larger diameter than the other guide rollers 532-536 because the transport belt segments 510, 514 may exert a larger load on the guide rollers 530, 540. The guide rollers 530-540 are rotatably mounted on the curved support rails 542, 544 so that the guide rollers 530-540 rotate as the transport belt segments 510, 514 pass over the circumferential surfaces of the respective guide rollers 530-540. One benefit of using multiple guide rollers arranged along a curve to bend the transport belt segments 510, 514 is that the transport belt segments 510, 514 are bent gradually along a relatively large diameter curve. Accordingly, the risk of the folded article 390 being permanently bent as a result of passing through the turn unit 224 is reduced. While the turn unit 224 of the present embodiment is disclosed as possessing six guide rollers, alternative embodiments can be arranged differently, e.g., with a single guide rollers, or any other suitable number of guide rollers.

The guide rollers 530-540 are rotatable, respectively, about rotational axes A1-A6. The rotational axes A1-A6 may each be parallel to a first axial direction so that the rotational axes A1-A6 are parallel to each other. The rotational axes A7, A8 of the input rollers 520, 522 may be parallel to each other and perpendicular to the first axial direction. As a result, the transport belt segments 510, 514 twist (e.g., rotate in a first rotational direction by 90 degrees) as the transport belt segments 510, 514 travel from the inlet 204 toward guide rollers 530-540 along the travel path P8, which is illustrated in FIG. 11. Similarly, the rotational axes of the output rollers 524, 526 may be parallel to each other and perpendicular to the first axial direction. Consequently, as shown in FIG. 12, the transport belt segments 510, 514 un-twist (e.g., rotate in a second rotational direction that is opposite to the first rotational direction by 90 degrees) as the transport belt segments 510, 514 travel from the guide rollers 530-540 toward the outlet 506 along the travel path P9. A result of the twisting and un-twisting of the transport belt segments 510, 514 is that the folded article 390 enters and exits the turn unit 224 in the same orientation.

Still referring to FIGS. 10-12, after the passing around the outlet roller 524, the return belt segment 512 is returned to the inlet 204 of the turn unit 224 by a series of horizontal return rollers 550-556 and a vertical return roller 558. The horizontal return rollers 550-556 may be perpendicular to the first axial direction, and the vertical return roller 558 may be parallel to the first axial direction. In a similar manner, subsequent to its passage around the outlet roller 526, the return belt segment 516 is returned to the inlet 204 by a series of horizontal return rollers 560-666, each being perpendicular to the first axial direction, and the vertical return roller 558.

Hinged glass panels 570, 572 may cover the top of the turn unit 224, as seen in FIGS. 8 and 9, so that an operator can easily see inside the turn unit 224 to assess the operating condition of the turn unit 224.

A rotational motor M may be coupled to the vertical return roller 558 to drive both of the conveyor belts 500, 502. As an alternative to the motor M, or as a supplement to the rotational motor M, other rotational motor(s) may be connected to the inlet rollers 520, 522, the outlet rollers 524, 526, and/or the return rollers 550-556 and 560-566. A variable speed controller (not illustrated) may be connected to the motor M, or to other rotational motors, to control the speed at which the folded article 390 passes through turn unit 224. The variable speed controller may employ variable-speed drive (VSD) to vary the speed of the turn unit 224 based on the thickness of the folded article 390 or other operating conditions. Furthermore, an analog potentiometer (not illustrated) may be attached to exterior of the turn unit 224 which allows an operator to manually set the speed of the turn unit 224.

The turn unit 224 may also include a jam detection system comprised of a series of photoelectric proximity sensors spaced throughout the turn unit 224. In one embodiment, three photoelectric proximity sensors PS1, PS2, PS3 are included in the turn unit. The proximity sensors PS1, PS2, PS3 detect the presence of the folded article 390 between the conveyor belts 500, 502 and communicate this information to a computer (not illustrated). The computer determines the travel time of the folded article 390 between the proximity sensors PS1, PS2, PS3, and if this travel time is less than a reference travel time, the operator is warned of a potential paper jam, for example, by a flashing light or an alarm.

The turn unit 224 can be easily implemented in a pre-existing folding system because the turn unit 224 simply needs to be positioned between any two of the processing units (i.e., folding units, pressing units, etc.) of the folding system such that the inlet 504 of the turn unit 224 aligns with the outlet of the upstream processing unit and the outlet 506 of the turn unit 224 aligns with the inlet of the downstream processing unit. It may not be necessary to use tools to outfit a pre-existing folding system with the turn unit 224 because of the relative simplicity of connecting the turn unit 224 to other processing units.

The turn unit 224 of FIG. 2 is configured to impart the folding system 6 with an L-shaped layout. In alternative embodiments, as shown in FIG. 14, the turn unit 224 can be used to create a folding system 600 with a Z-shaped layout.

Figure 14:
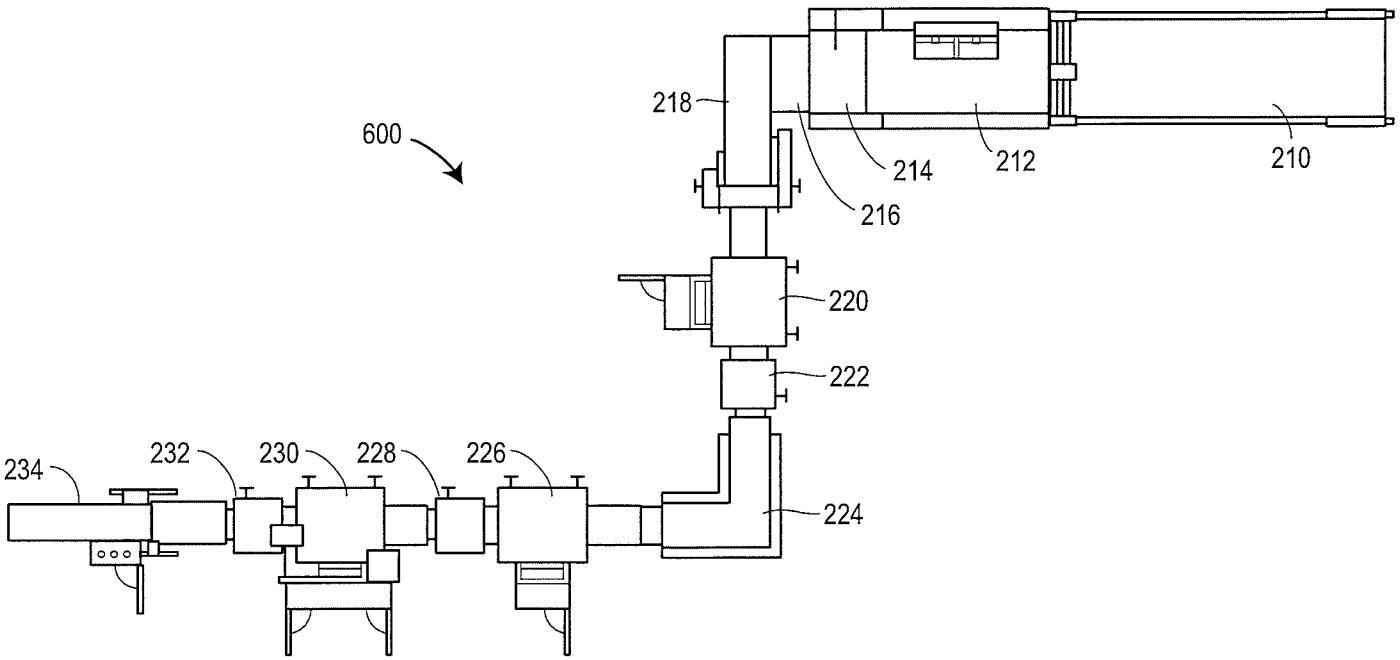
FIG. 14 is a top view of an alternative embodiment of the folding system of the present disclosure.

The position of the turn unit 224 along the assembly line is not limited to that shown in FIG. 2 or 14. For example, in other embodiments, the turn unit 224 could be positioned between the folding units 218 and 220, or between the folding unit 220 and the pressing unit 222, or between the folding unit 226 and the pressing unit 228, or between the pressing unit 228 and the folding unit 230, or between the folding unit 230 and the pressing unit 232, or between the pressing unit 232 and the vertical stacker delivery unit 234. Furthermore, a second turn unit, similar in construction to the turn unit 224, could be positioned downstream of the turn unit 224, so that the layout of the folding system is square-shaped.

Pressing Units 228 and Pressing Unit 232

The structure and operation of each of the pressing units 228 and 232 may be the same as the pressing unit 222. The folded article 390 generally moves along linear travel paths P11 and P13, respectively, as it passes through pressing unit 228 and 232. The travel paths P11 and P13 may be parallel and/or coextensive with the travel paths 10 and 12, respectively.

Vertical Stacker Delivery Unit 234

The vertical stacker delivery unit 234 receives the folded articles output by the pressing unit 232 and arranges them adjacent one another along a horizontal direction. The vertical stacker delivery unit 234 may hold each of the folded articles in an upright orientation so that an upwardly facing face of the folded article is formed by a single one of the folds.

The presently disclosed folding system advantageously provides a layout of processing units that minimizes usage of floor space and/or facilitates the compact arrangement of the folding system with other folding systems or machines on a factory floor. Moreover, the presently disclosed turn unit can be easily implemented in a pre-existing folding system to alter its layout to save floor space.

While the present disclosure has been described with respect to certain embodiments, it will be understood that variations may be made thereto that are still within the scope of the appended claims.

What is claimed is:

1. A system that forms informational items having information printed thereon, the system comprising:

a first folding unit configured to form a first folded article from a sheet of paper having information printed thereon, the first folding unit defining a first linear travel path for the sheet of paper and having a plurality of folding rollers configured to form the sheet of paper into the first folded article by making a plurality of folds parallel to a first folding direction in the sheet of paper;

a second folding unit defining a second linear travel path that is perpendicular to the first linear travel path and operatively coupled downstream of the first folding unit to receive the first folded article, the second folding unit being configured to form a second folded article by making at least one fold in the first folded article parallel to a second folding direction that is perpendicular to the first folding direction;

a turn unit operatively coupled downstream of the second folding unit to receive the second folded article, the turn unit defining an inlet disposed on a third linear travel path that is coextensive with the second linear travel path and an outlet disposed on a fourth linear travel path that is perpendicular to the second and third travel paths such that the turn unit receives the second folded article from the second folding unit through the inlet and conveys the second folded article along the third linear travel path to the fourth linear travel path to the outlet, the turn unit further including:

a first belt segment and a second belt segment arranged in opposition to each other and configured to grip the second folded article therebetween, and a plurality of guide rollers arranged along a curve to guide the first and second belt segments along a curved travel path between the third and fourth travel paths, each of the guide rollers being rotatable about a respective rotational axis that is parallel to a first axial direction; and a third folding unit defining a fifth linear travel path that is coextensive with the fourth linear travel path and operatively coupled to the turn unit to receive the second article from the outlet of the turn unit, the third folding unit being configured to form a third folded article by making at least one fold in the second article parallel to the second folding direction.

2. The system of claim 1, the turn unit including a pair of inlet rollers arranged in opposition to each other at the inlet such that the first and second belt segments pass between the inlet rollers, each of the inlet rollers being rotatable about a respective rotational axis that is perpendicular to the first axial direction.

3. The system of claim 2, the turn unit including a pair of outlet rollers arranged in opposition to each other at the outlet such that the first and second belt segments pass between the outlet rollers, each of the outlet rollers being rotatable about a respective rotational axis that is perpendicular to the first axial direction.

4. The system of claim 1, wherein the first folding unit, the second folding unit, the turn unit, and the third folding unit form a U-shape or Z-shape when viewed from above.

5. The system of claim 1, comprising a jam detector configured to determine if a paper jam has occurred based on an amount of travel time of a sheet of paper between two sensors, at least one of the sensors being located in the turn unit.

6. The system of claim 1, wherein third travel path, the fourth travel path and the curved travel path all reside within a common horizontal plane such that the sheet of paper continuously resides within a single horizontal plane as it passes through the turn unit.

7. A system for folding a sheet of material, the system comprising:

a first folding unit configured to convey the sheet along a first travel path and including a first plurality of folding rollers to form a plurality of folds in the sheet, each of the folds being parallel to a first folding direction;

a second folding unit arranged downstream of the first folding unit and configured to convey the sheet along a second travel path that is perpendicular to the first travel path, the second folding unit including a second plurality of folding rollers to form at least one fold in the sheet in a second folding direction that is perpendicular to the first folding direction; and a turn unit arranged downstream of the second folding unit, the turn unit including an inlet positioned along a third travel path that is parallel to the second travel path, an outlet positioned along a fourth travel path that is transverse to the third travel path, and a conveyor configured to convey the sheet from the inlet to the outlet, wherein the turn unit includes a plurality of guide rollers arranged along a curve to guide the conveyor along a curved travel path between the third and fourth travel paths, each of the guide rollers being rotatable about a respective rotational axis that is parallel to a first axial direction.

8. The system of claim 7, wherein a bend in the conveyor redirects the sheet from the third travel path to the fourth travel path.

9. The system of claim 7, the conveyor including a first belt segment and a second belt segment arranged in opposition to each other and configured to grip the sheet therebetween.

10. The system of claim 9, the turn unit including a pair of inlet rollers arranged in opposition to each other at the inlet such that the first and second belt segments pass between the inlet rollers, each of the inlet rollers being rotatable about a respective rotational axis that is perpendicular to the first axial direction.

11. The system of claim 10, the turn unit including a pair of outlet rollers arranged in opposition to each other at the outlet such that the first and second belt segments pass between the outlet rollers, each of the outlet rollers being rotatable about a respective rotational axis that is perpendicular to the first axial direction.

12. The system of claim 7, the third travel path being perpendicular to the fourth travel path.

13. The system of claim 7, the third travel path and the fourth travel path form an angle in a range of about 60 degrees to about 120 degrees.

14. The system of claim 7, comprising a third folding unit arranged downstream of the turn unit and configured to convey the sheet along a fifth travel path that is parallel to the fourth travel path, the third folding unit including a third plurality of folding rollers to form at least one fold in the sheet in the second folding direction, wherein the first folding unit, the second folding unit, the turn unit, and the third folding unit form a U-shape or Z-shape when viewed from above.

15. The system of claim 7, comprising a jam detector configured to determine if a jam has occurred based on an amount of travel time of the sheet between two sensors, at least one of the sensor being located in the turn unit.

16. The system of claim 7, wherein the third travel path, the fourth travel path and the curved travel path all reside within a common horizontal plane such that the sheet of paper continuously resides within a single horizontal plane as it passes through the turn unit.

17. A method of folding a sheet of paper having information printed thereon, the method comprising:

conveying the sheet of paper along a first travel path;

forming a plurality of folds in the sheet of paper, each of the folds being parallel to a first folding direction;

conveying the sheet of paper along a second travel path that is perpendicular to the first travel path;

forming at least one fold in the sheet of paper in a second folding direction that is perpendicular to the first folding direction;

conveying the sheet of paper along a third travel path that is parallel to the second travel path while rotating the sheet of paper in a first rotational direction;

conveying the sheet of paper along a fourth travel path that is perpendicular to the third travel path while rotating the sheet of paper in a second rotational direction that is opposite to the first rotational direction; and wherein the sheet of paper is conveyed along a curved travel path between the third travel path and the fourth travel path, the curved travel path disposed on a curve defined by a plurality of guide rollers being rotatable about a respective rotational axis that is parallel to a first axial direction.

18. The method of claim 17, wherein the sheet of paper is rotated by 90 degrees in the first rotational direction while being conveyed along the third travel path, and the sheet of paper is rotated by 90 degrees in the second rotational direction while being conveyed along the fourth travel path.

19. The method of claim 17, comprising forming at least one fold in the sheet of paper in the second folding direction after conveying the sheet of paper along the fourth travel path.

20. The method of claim 17, wherein conveying the sheet of paper along the third travel path, fourth travel path, and curved travel path comprises conveying the sheet of paper within a single horizontal plane.

* * * * *